US005375439A

United States Patent [19]

Nehren et al.

[11] Patent Number: 5,375,439

[45] Date of Patent: Dec. 27, 1994

[54] ELASTIC MEMBRANE DOORS FOR INDUSTRIAL WASHER-EXTRACTOR CYLINDERS

[75] Inventors: William C. Nehren, Wichita Falls; Russell C. Kissick, Plano; Constantin Anastase; Thomas C. Campbell, both of Wichita Falls, all of Tex.

[73] Assignee: White Consolidated Industries, Inc., Cleveland, Ohio

[21] Appl. No.: 138,408

[22] Filed: Oct. 18, 1993

[51] Int. Cl.[5] ..... D06F 37/10

[52] U.S. Cl. ..... 68/139; 68/196; 220/324

[58] Field of Search ..... 68/139, 142, 143, 196; 220/324, 326, 668, 670, 673, 676; 210/380.2, 380.3, 402; 51/164.1; 209/286, 401, 403, 405; 34/133 A, 133 G; 366/234

[56] References Cited

U.S. PATENT DOCUMENTS

| | | | |
|---|---|---|---|
| 653,045 | 7/1900 | Walter et al. | 209/286 X |
| 1,117,106 | 11/1914 | Teg | 209/286 |
| 1,396,456 | 11/1921 | Mueller | 68/142 |
| 2,370,315 | 2/1945 | Jones et al. | 210/380.3 |
| 2,774,506 | 12/1956 | Miller | 68/139 X |
| 2,867,106 | 1/1959 | Stone, Jr. et al. | 68/142 X |
| 3,965,704 | 6/1976 | Vanderheyden | 68/143 X |

FOREIGN PATENT DOCUMENTS

| | | | |
|---|---|---|---|
| 2225130 | 12/1973 | Germany . | |
| 22255 | of 1895 | United Kingdom | 209/286 |
| 149038 | 7/1920 | United Kingdom | 210/380.3 |

*Primary Examiner*—Philip R. Coe

*Attorney, Agent, or Firm*—Pearne, Gordon, McCoy & Granger

[57] ABSTRACT

An improved door for a horizontal axis fabric treatment machine. The door is designed to removably cover an access opening in a perforated inner drum and includes a series of interwoven elongated fabric strips which are attached at each end to the drum by a series of buckles. The buckles include a frame portion attached to the drum and a tongue portion attached to an end of the elongated fabric strip. The fabric strips define living hinges adjacent each end thereof, allowing the door to open in a number of directions. The access opening is revealed by opening the buckles on three sides of the door, and pivoting the door about the living hinge provided on the fourth side. The buckles allow the door to be completely removed and replaced without tools. The door exploits membrane stiffness to retain, support, and transfer the weight or load from the door to the surrounding drum.

13 Claims, 2 Drawing Sheets

Fig.2
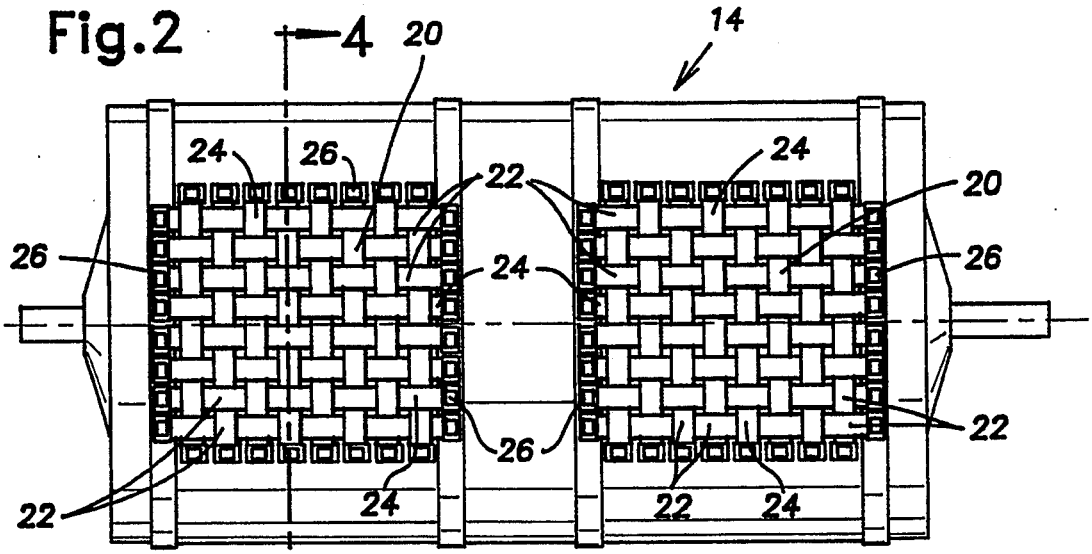
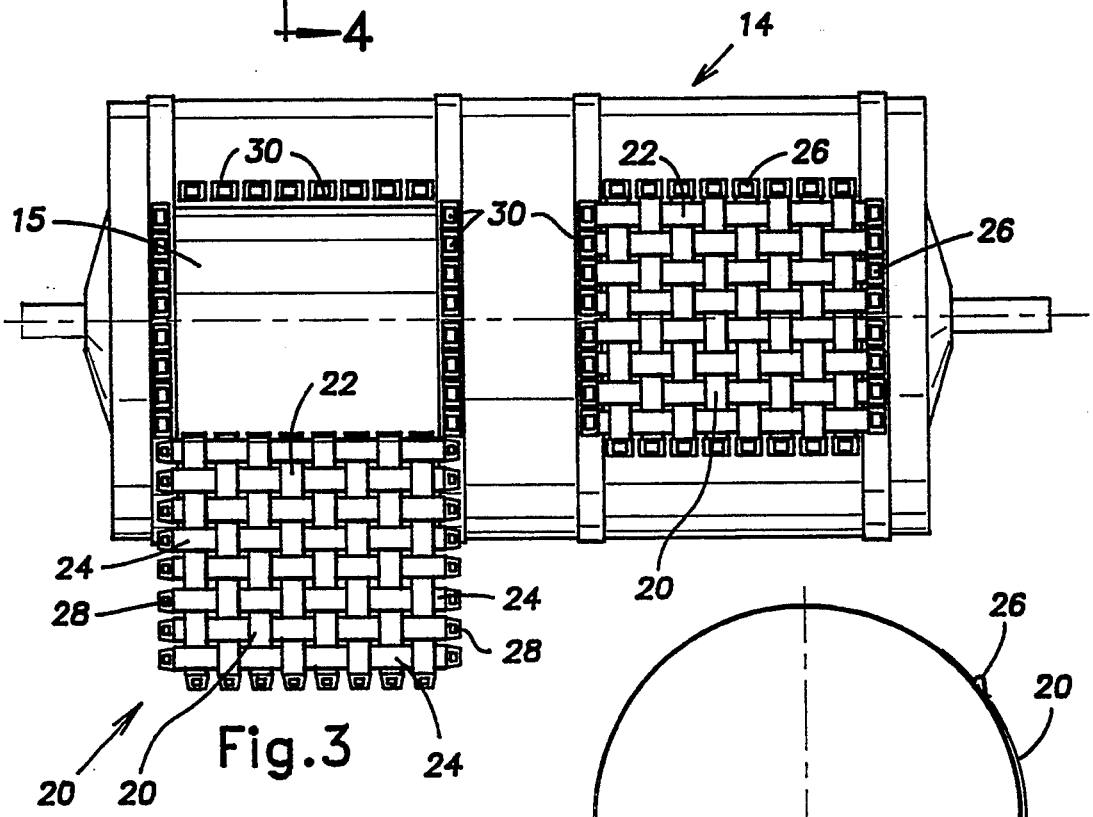
Fig.3
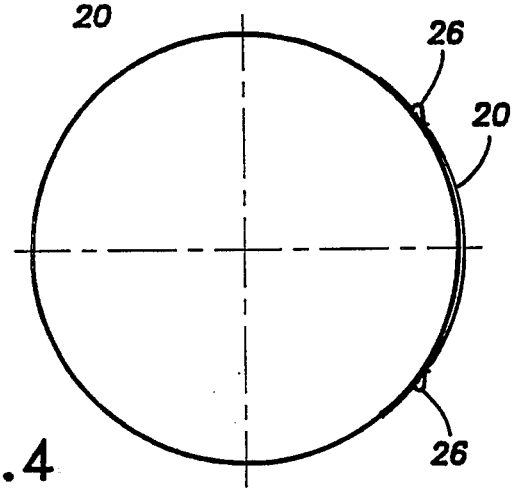
Fig.4

ELASTIC MEMBRANE DOORS FOR INDUSTRIAL WASHER-EXTRACTOR CYLINDERS

BACKGROUND OF THE INVENTION

1. Field of the Invention

The present invention generally pertains to industrial fabric treatment machines and, more particularly, to access doors for industrial horizontal-axis fabric treatment machines.

2. Description of the Related Art

During the development of horizontal axis fabric treatment machines it has been common to provide a door in the cylindrical sidewall of a clothes treatment cylinder or drum to allow access into the interior of the drum for insertion of items therein and removal of items therefrom.

Typically, the door is formed by one or more curved plates of steel. The weight of the door combined with the weight of treated fabric thereon requires a rather massive support structure to maintain the door on the drum. The load on the door is primarily supported by the bending stiffness of the door. Bending stiffness describes a resistance to a combination of stresses that the door experiences, such as tensile, compressive, and shear stresses. Bending stiffness inefficiently supports the weight, and requires the door to be mechanically stronger than would be required if the membrane stiffness of the door could be exploited. Generally speaking, membrane stiffness is a resistance to a single type of stress, such as tensile stress, wherein all parts of the door are under tension and thereby cooperate to transfer the load to the surrounding drum.

Doors conventionally employed in fabric treatment machines are stiff and inflexible, and require mechanically strong hinges to mount the door to the drum. These hinges are expensive, and require the door to pivotally open about a fixed axis which, depending upon the orientation of the washing machine to the surrounding equipment, may not be convenient.

Therefore, there exists a need in the art for an access door for an inner drum of a fabric treatment machine which selectively pivots about one or more axes. Moreover, there exists a need in the art for a door which employs or exploits membrane stiffness to support the load of processed or treated fabrics, and thereby more efficiently supports the treated fabrics than doors which rely upon bending stiffness, as in the prior art. There also exists a need in the art for a door which eliminates the need for expensive hinges.

SUMMARY OF THE INVENTION

The present invention provides a flexible door which covers an access opening in a sidewall of a perforated cylindrical drum. The flexible door is adapted to removably cover the access opening and provides a flexible body section and means for securing the body section to the drum.

In accordance with the present invention, the body section of the door provides a living hinge and is defined by a series of interwoven elongated members. Each of the elongated members is formed from an flexible or elastic membrane or fabric, and are interwoven to create a strong but lightweight flexible body section. The elongated members are interwoven in a plain weave, and have at least one end secured to the drum by the securing means. The body section is adapted to bend about either end of the elongated members to allow the door to open in more than one direction and thereby provide access to the interior of the drum via the access opening.

In further accordance with the present invention, the securing means comprises a buckle associated with at least one end of the elongated members. The buckle, which is preferably of the seat belt-type, has a tongue and a frame. One of the tongue and frame is attached to an end of the elongated member and the other of the tongue and frame is attached to the drum adjacent the access opening.

In further accordance with the present invention the securing means is attached to each end of the elongated members. Since the elongated members extend parallel and perpendicular to each other, the flexible door is adapted to open in any one of four directions depending upon which securing means are unattached from the drum. Also, the door can be easily removed from and re-attached to the drum without the use of any tools by operation of the securing means.

Weight bearing upon any of the elongated members is transferred, at least in part, to other elongated members. The elongated members are in tension and transfer the load efficiently to the surrounding drum. The resulting door structure is more light weight, stronger, and easier to open and close than the doors known in the art.

BRIEF DESCRIPTION OF THE DRAWINGS

These and further features of the present invention will be apparent with reference to the following description and drawings, wherein:

FIG. 2 is a front elevational view of an inner drum with the flexible doors of the present invention shown in an operative or closed position;

FIG. 3 is a front elevational view of the inner drum with the flexible doors of the present invention shown in an open position with the interior of the drum accessible via the access opening; and FIG. 4 is a cross sectional view of the inner drum as viewed along lines 4—4 of FIG. 2.

DETAILED DESCRIPTION OF THE PREFERRED EMBODIMENT

Figure 1:
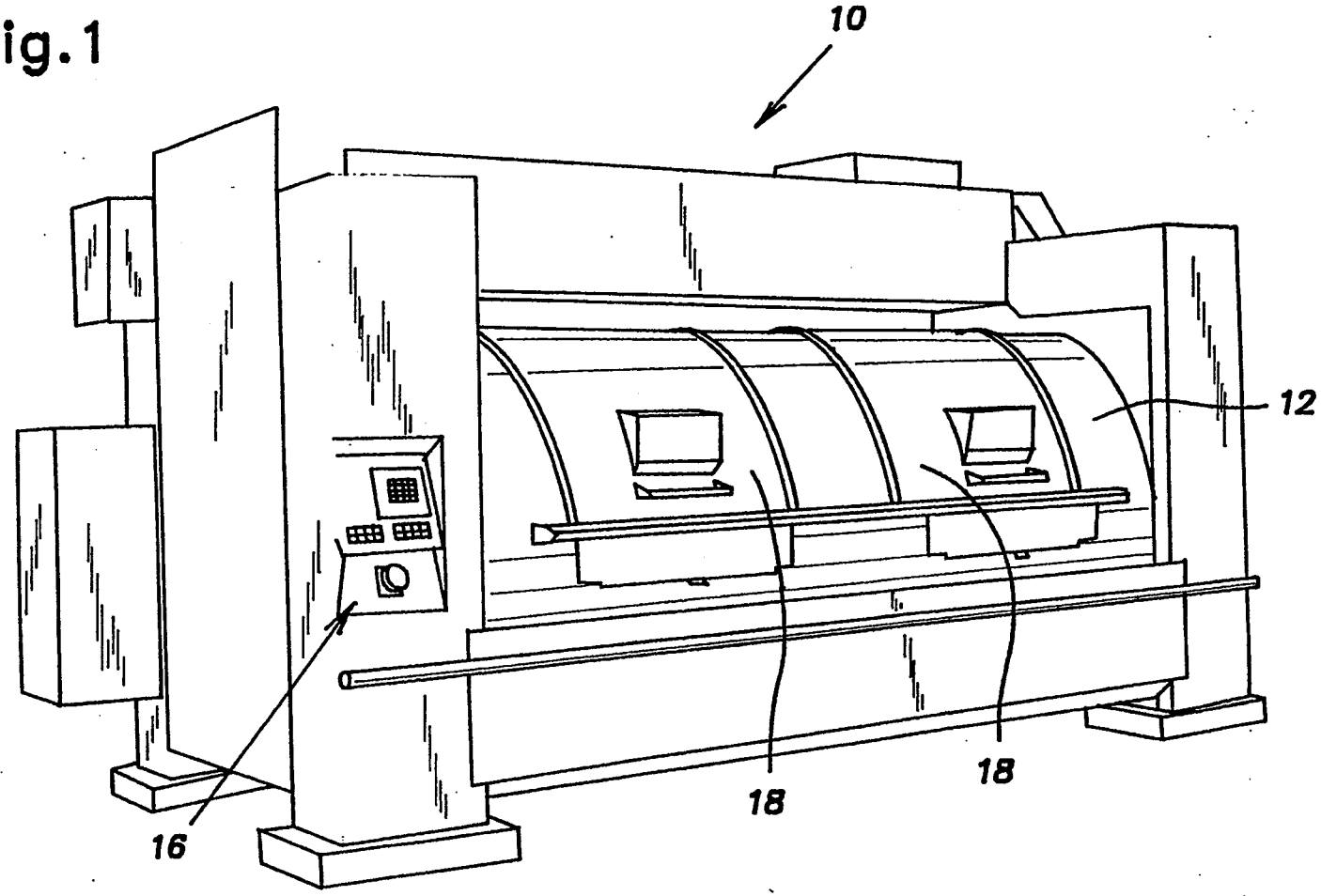
FIG. 1 is a perspective view of a side loading horizontal axis industrial laundry machine in accordance with the present invention.

With reference to FIG. 1, a horizontal axis, side loading, industrial fabric treatment machine 10 is illustrated. The machine 10 includes an outer imperforate drum or basket 12 and an inner perforate drum 14 (FIGS. 2 and 3). As is generally well known in the art, the inner drum 14 is supported at each end for rotation within the outer drum 12, and is perforated to allow wash liquid to flow therethrough. The outer drum 12 is stationary and water impervious, and defines a fluid receptacle in which the inner drum 14 rotates. The outer drum includes means (not shown) to allow fluid to be introduced therein and removed therefrom. A control panel 16 is preferably provided to allow an operator to control and monitor the operation of the machine 10.

As shown best in FIG. 1, the outer drum 12 includes a pair of doors 18 through which access to the inner drum 14 is available. Naturally, the use of two doors 18 is merely illustrative, and can be replaced by a single door, or more than two doors, as required. The inner drum 14 provides a like number of access doors 20 (FIGS. 2–4), in this case two, which automatically align with the doors 18 in the outer drum 12 when the inner drum 14 comes to rest at the completion of a cycle. Since the alignment means do not make up part of the present invention, and several alignment means are known in the art, they will not be further described herein.

The inner drum 14 is generally cylindrical and may be divided into two or more internal compartments. In the inner drum 14 illustrated in FIGS. 2 and 3, the drum 14 is separated into two compartments, each of which is accessible through an access opening 15 which is covered by one of the inner access doors 20.

Each of the inner doors 20 comprise a series of elongated members 22. The elongated members 22 are preferably made of a flexible resilient or elastic fabric and, most preferably, are woven natural or artificial fibers or metal belts. The elongated members 22 are themselves interwoven, preferably in a plain weave, as illustrated.

Ends 24 of the elongated members 22 are attached to the inner drum 14 by a securing means which, in the illustrated and preferred embodiment, includes a series of seat-belt type buckles 26. As shown best in FIG. 3, a tongue 28 of each buckle 26 is attached to an end 24 of each elongated member 22, and a frame 30 of the buckle 28 is attached to the inner drum 14 adjacent the access opening therein. Naturally, this arrangement could be reversed so that the buckle tongues 28 are attached to the drum 14 and the buckle frames 30 are secured to the ends 24 of the elongated members 22.

The elongated members 22 are unattached from the inner drum 14 by depressing a button (not shown) on the buckle frame 30, and withdrawing the tongue 28 from a slot (not shown) in the buckle 26. Similarly, the elongated member 22 is reattached to the inner drum 14 by sliding the tongue 28 into the slot in the frame 30 until a projection of the button is received within an opening in the tongue 28.

As is shown in FIG. 3, the access opening 15 is revealed and accessible by unlatching the buckles 26 on three of the four sides of the door 20, and folding the door 20 away from the inner drum 14. The elongated members 2 comprising the elastic door 20 are flexible and resilient, and thereby allow the ends 24 to define a living hinge adjacent the union with the inner drum 14 about which the door 20 pivots or bends. In this manner, the elastic or resilient door 20 is able to bend or open in any of four directions. The door 20 can be completely removed from the inner drum 14 simply by unattaching the buckles 26 on all four sides thereof from the inner drum 14.

The buckles 26 illustrated herein attach and un-attach individual ends 24 of the elongated members 22 to the inner drum 20. It is contemplated that the attachment and unattachment of the elongated members 22 and the inner drum 14 could be eased and speeded by ganging the buckles 26 along each side together so that they are simultaneously operated. Moreover, it is contemplated that a single direction of opening may be decided upon and, therefore, it may be desirable to gang the buckles 26 along three sides together to further speed and ease and speed attachment and unattachment of the elastic access door 20 and the inner drum 14.

When the access doors 20 are closed during a wash or water extraction mode of machine operation, a considerable weight of material being treated bears against the access doors 20. Since the access door 20 connects or attaches to the inner drum 14 at several points along each edge and due to the elastic properties of the interwoven elongated members 22, the weight or load of the treated material is transferred to the drum 14 at numerous spaced-apart locations surrounding the access opening. When the weight is placed upon one of the elongated members 22, that weight is transferred, in part, to the other elongated members 22, due to the weave, placing the entire door in tension and efficiently transferring the treated fabric load to the drum. The elasticity of the elongated members 22 also allows the access door 20 to bulge or deform outwardly. The ability of the door 20 to deform radially outwardly is limited by the inherent elasticity of the elongated members 22 and, at an outer extreme, by the outer drum 12. Therefore, the elongated members 22 preferably deform radially outwardly, but not so much that the door 20 engages the outer drum 12.

As used herein the term "fabric" is intended to include resilient or compliant natural or artificial fibers such as KEVLAR, polyester, or NOMEX which, alone or in combination with other natural or artificial fibers, plastics, metals, or alloys are grouped, twisted, matted, woven, or otherwise joined to form a continuous or discontinuous sheet, strip, or belt of material. For example, instead of a series of interwoven strips of material, the doors 20 could be formed of a single continuous perforated sheet of resilient or elastic fabric which is attached to the drum 14 over the access opening 15 by securing means without departing from the scope of the present invention.

The term "living hinge" as used herein defines a hinge which is integrally formed in a material, and is a result of the elastic or resilient properties of that material. The term "living hinge" is to be accorded its broadest possible interpretation, and is not intended to imply that there is a specific axis about which the door bends, or that there is an inherent weakness in the material along the axis or at the hinge line. Rather, in the present invention, the "living hinge" is integrally provided at any point along the straps and, preferably, adjacent each end of the straps, depending upon which direction the door is opened.

While the preferred embodiment of the present invention is shown and described herein, it is to be understood that the same is not so limited but shall cover and include any and all modifications thereof which fall within the purview of the invention.

What is claimed is:

1. A horizontal axis fabric treatment machine comprising a rotatable drum defining an access opening through which an interior of the drum is available, a door having a flexible body section which provides a living hinge and is adapted to cover the access opening, and means for securing the body section to the drum, said body section being adapted to elastically bend about the living hinge to reveal the access opening.

2. A horizontal axis washing machine according to claim 1, wherein the main body section comprises a series of elongated resilient members, an end of at least one of said members being attached to the drum by the securing means.

3. A horizontal axis washing machine according to claim 2, wherein the elongated resilient members have ends which are attached to the drum by the securing means and the door is adapted to bend about either end of the elongated members to open in more than one direction.

4. A horizontal axis washing machine according to claim 2, wherein the elongated members are interwoven, and the door is adapted to selectively bend about axes adjacent ends of the elongated members to allow the door to open in a plurality of directions.

5. A horizontal axis washing machine according to claim 2, wherein the securing means comprises a seat belt-type buckle.

6. A horizontal axis washing machine according to claim 5, wherein the buckle includes a tongue and a frame, each end of the elongated members is associated with one of said tongue and frame.

7. A horizontal axis washing machine according to claim 6, wherein the other of the tongue or frame is attached to the drum.

8. A horizontal axis washing machine according to claim 7, wherein the elongated members are interwoven, and the door is adapted to selectively bend about axes adjacent ends of the elongated members and thereby open in a plurality of directions.

9. A door for covering an access opening in a rotatable drum, said door comprising a body section and means for securing the body section to the drum, said body section comprising an elastic membrane and said securing means releasably attaching an end of said elastic membrane to the drum, wherein the securing means comprises a plurality of buckles, each end of the elastic membrane being attached to the drum by one of the buckles.

10. A door according to claim 9, wherein the end of the elastic membrane attaches to either a tongue or a frame of the buckle and the other of the tongue or frame is attached to the drum.

11. A horizontal axis fabric treatment machine comprising a rotatable drum defining an access opening, a door having an elastically flexible body section and being adapted to cover the access opening, and means for securing the door to the drum, the body section including a series of interwoven elongated members and being adapted to resiliently bend away from the drum to permit access to an interior of the drum via the access opening, wherein the securing means releasably attaches a plurality of elongated member ends to the drum to allow the door to alternatively open in any one of a plurality of directions.

12. A horizontal axis fabric treatment machine according to claim 11, wherein the elongated members are formed of a fabric material and each end of the elongated members is attached to the drum by the securing means.

13. A horizontal axis fabric treatment machine according to claim 11, wherein the elongated members are formed from a fabric material and the securing means comprises a buckle, each end of the elongated members being attached to the drum by one of the buckles.

* * * * *